United States Patent [19]

Toburen et al.

[11] 4,403,545

[45] Sep. 13, 1983

[54] CAN CRUSHING DEVICE

[76] Inventors: Delmar K. Toburen, Rte. #1, Box 61, Riley, Kans. 67531; Dennis L. Toburen; Steven R. Toburen, both of 931 Lincoln, Clay Center, Kans. 67432

[21] Appl. No.: 337,581

[22] Filed: Jan. 7, 1982

[51] Int. Cl.[3] ..... B30B 15/30

[52] U.S. Cl. ..... 100/215; 100/233; 100/293; 100/295; 100/902

[58] Field of Search ..... 100/215, 233, 293, 295, 100/902; 241/99

[56] References Cited

U.S. PATENT DOCUMENTS 3,667,386 6/1972 Workman ..... 100/902 X
3,980,015 9/1976 Woodard ..... 100/902 X
4,212,242 7/1980 Willis ..... 100/902 X
4,358,994 11/1982 Talley ..... 100/902 X

FOREIGN PATENT DOCUMENTS 2011302 7/1979 United Kingdom ..... 100/902

*Primary Examiner*—Billy J. Wilhite
*Attorney, Agent, or Firm*—Edwin H. Crabtree

[57] ABSTRACT

A can crusher for flattening cylindrical cans such as soft drink and beer cans made of aluminum. The crusher is designed to receive a plurality of cans, one on top of the other. The crusher crimps the cans prior to folding and flattening the top and bottom of the can against the sides of the can. The crusher is operated by raising and lowering a handle and the cans are flattened as fast as the cans can be loaded into the top of the crusher.

5 Claims, 5 Drawing Figures

CAN CRUSHING DEVICE

BACKGROUND OF THE INVENTION

This invention relates to a can crusher for flatening a cylindrical can and more particularly but not by way of limitation to a can crusher which crimps the top and bottom of the can inwardly against the sides of the can prior to completely flatening the top, bottom and sides of the can together and discharging the flatened can from the crusher housing.

In the United States people have begun to recognize the growing shortage of not only precious metals but base metals and the growing need to conserve and recycle these metals. Therefore, more and more people running restaurants, bars, cafes and other businesses now take the time to collect particularly aluminum cans and sell them to companies that recycle the metal. The companies that buy the cans not only prefer but require the cans be flatened for ease in storage and shipping. Because of this there is a growing demand for an efficient and an economical can crusher.

Heretofore, there have been different types of can crushing devices such as the devices disclosed in U.S. Pat. No. 4,212,242 to Willis, U.S. Pat. No. 3,980,015 to Woodard, U.S. Pat. No. 3,667,386 to Workman and U.S. Pat. No. 3,766,849 to Maron. While these patents disclose various ways of flatening a cylindrical can none of them show the unique structure and advantages of the subject invention as described herein.

SUMMARY OF THE INVENTION

The subject can crusher provides a means for semi-automatically crushing cylindrical cans through the use of a handle. By raising and lowering the handle cans can be quickly flatened and discharged as fast as the can crusher can be loaded. The can crusher further provides a hopper which can be continuously loaded as the crusher is operated for quickly receiving and crushing the cans.

The can crusher is simple in design, rugged in construction and may be mounted on a wall, bar, cabinet or the like.

The invention provides individuals and businesses with an inexpensive but efficient crushing device which will rapidly and conveniently flaten aluminum cans which can be recycled and sold for a profit. By flatening the cans the size of storage is reduced and the cost of shipping is decreased.

The can crusher includes a hopper for receiving a plurality of cans therein . The cans are laid on their sides in a horizontal position, one on top of the other. A crusher housing is disposed below the hopper and receives the cans therein by gravity. A handle is pivotally mounted on the front of the housing for operating the crusher. Mounted inside the housing is a front crusher plate attached to a first and second pivoting crusher plate which are used for flatening the top and bottom of a can against the sides of the can. A crimp pin is vertically mounted on top of the front crusher plate. The pin crimps a can disposed above the can being crushed in the housing. When the can is completely flatened in the crusher housing the can is discharged out the bottom of the housing.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
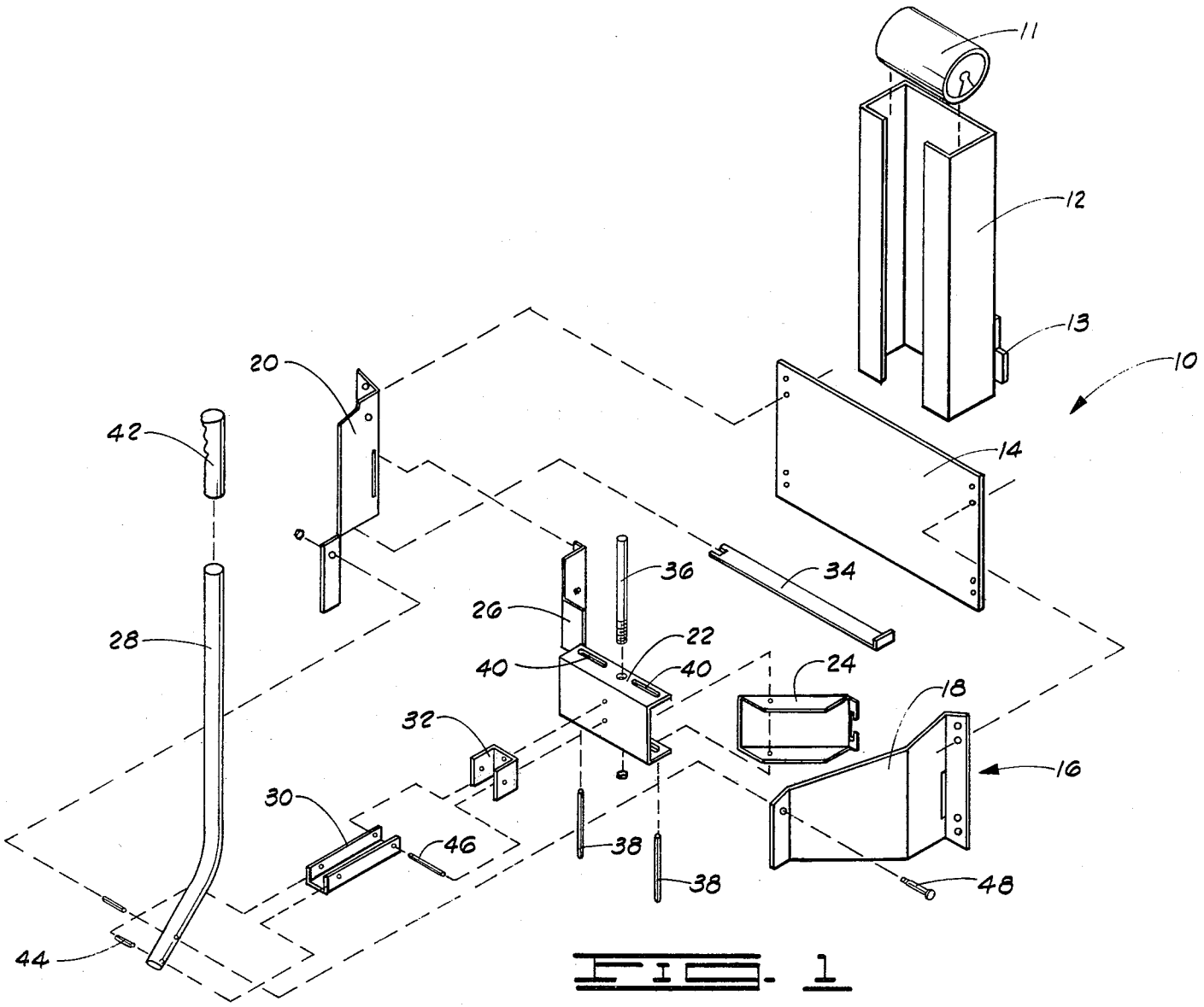
FIG. 1 is an exploded perspective view of the can crusher for receiving cylindrical cans therein.

In FIG. 1 an exploded view of the can crusher is illustrated and designated by general reference numeral 10. The crusher 10 is designed for receiving a plurality of cylindrical cans 11. The cans 11 shown in the drawings may be made of aluminum, steel or any other commonly used metals for holding soft drinks, beer or any other food product. The crusher is used when it is desired to save or recycle the cans in the interest of ecology.

Broadly, the crusher 10 includes a can hopper 12 having a clip 13 mounted on the back thereof for securing the hopper 12 to the top of a mounting plate 14. The mounting plate 14 is used for securing the crusher 10 to a vertical wall, bar or cabinet or any other structure used for receiving the crusher 10 thereon. Attached to the mounting plate 14 is a crusher housing 16 which includes a first side plate 18, a second side plate 20 and a front crusher plate 22. Slidably mounted to the front crusher plate 22 and to the sides of the first side plate 18 and second side plate 20 is a first pivoting crusher plate 24 and a second pivoting crusher plate 26. A handle 28 is pivotally attached to a handle pivot link 30 which in turn is attached to a handle link mount 32 mounted on the front of the front crusher plate 22. A stiffener strap 34 is attached to the bottom of the first side plate 18 and second side plate 20 for reinforcing the crusher housing 16 and receiving a can 11 to be crushed on top thereof.

Also shown in FIG. 1 is a vertical crimp pin 36 which is attached to the top of the front crusher plate 22 and used for crimping the cans 11 prior to one of the cans 11 being received inside the housing 16. The front crusher plate 22 further includes a pair of pins 38 slidably received through slots 40 and through one end of the first pivoting crusher plate 24 and one end of the second crusher plate 26. As the front crusher plate 22 is moved forward into the housing 16 as the handle 28 is lowered, the first pivoting crusher plate 24 and second pivoting crusher plate 26 slide forward in the slots 40 and inwardly toward the center of the front crusher plate 22 thereby flatening the top and bottom of the can 11. The flatening of the can 11 is more clearly illustrated in FIGS. 4 and 5.

The handle 28 includes a handle grip 42. The handle 28 is pinned to the handle pivot link by a pin 44. Further the handle pivot link 26 is connected to the handle link mount 32 by a pin 46. The handle 28 is an over-center handle and is also conntected to the front of the housing 16 by a pin 48 received through the sides of the first side plate 18 and second side plate 20.

Figure 2:
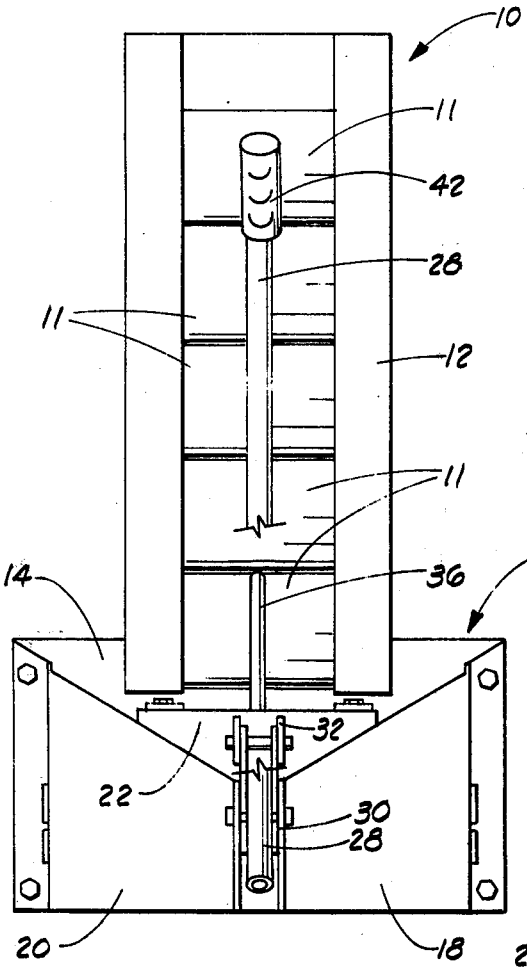
FIG. 2 is a front view of the can crusher with the handle in a raised position.

In FIG. 2 a front view of the can crusher 10 is illustrated receiving a plurality of cans 11 in the hopper 12. You will note that the cans 11 are laid on their sides in a horizontal position one on top of the other. In this view a portion of the handle 28 has been cut away to expose the front of the front crusher plate 22 and the crimp pin 36. In this view, the handle is in a raised position for actuating the crusher 10.

Figure 3:
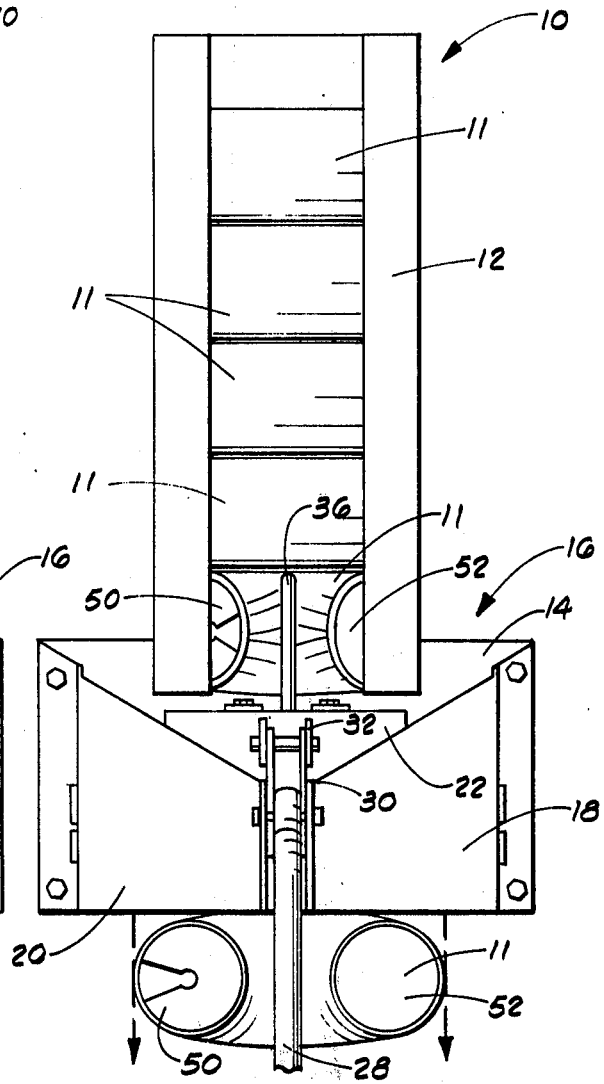
FIG. 3 is a front view of the can crusher with the handle lowered crushing a can in a housing with a can being flatened and discharged out the bottom of the housing.

In FIG. 3 the handle 28 has been lowered with the handle pivot link 30 moving the front crusher plate 22 forward into the crusher housing 16. At the same time the crimp pin 36 engages a can 11 disposed in the bottom of the hopper 12 and above the can 11 which has dropped into the housing 16. You will note in FIG. 3 that as the crimp pin 36 moves forward engaging the center of the can 11 a top 50 and bottom 52 of the can 11 are urged inwardly toward the center of the can for preparing this can to be crushed inside the housing 16. Also FIG. 3 shows a can 11 being discharged out the bottom of the housing 16. This occurs after the can 11 has been completely crushed and the handle 28 raised thereby releasing the can from the sides of the first pivoting crusher plate 24 and second pivoting crusher plate 26.

Figure 4:
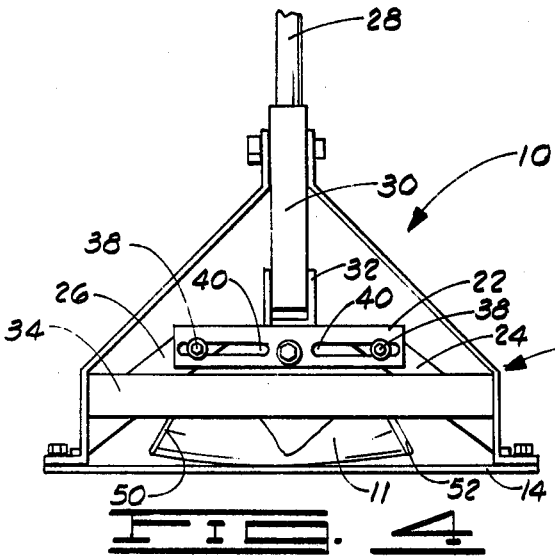
FIG. 4 is a bottom view of the can crusher prior to lowering the handle of the crusher.

In FIG. 4 a bottom view of the can crusher 10 and crusher housing 16 can be seen prior to the handle 28 being lowered for crushing the can 11 therein. In this figure, the crimped can 11 has been received in the housing 16 and rests on top of the stiffener strap 34. The first pivoting crusher plate 24 and second crusher plate 26 are in a position to engage the top 50 and bottom 52 of the can 11 for urging the top 50 and bottom 52 inwardly flattening them against the sides of the can 11.

Figure 5:
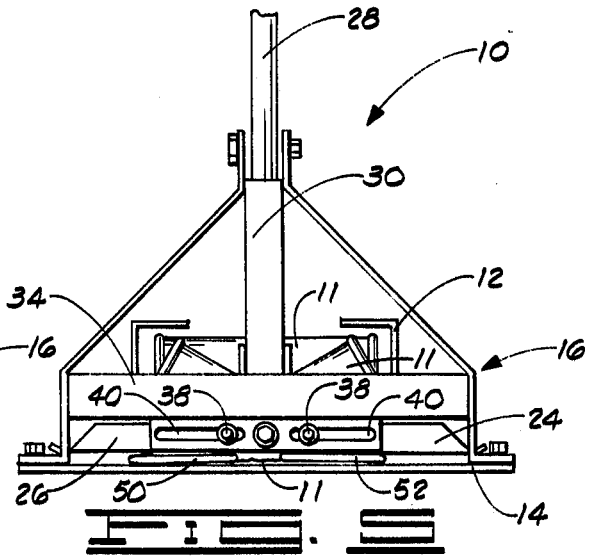
FIG. 5 is a bottom view of the can crusher with the handle actuated and lowered crushing the can in the housing and crimping the can above the crushed can.

In FIG. 5 the handle 28 has been lowered as shown in FIG. 3 urging the first pivoting crusher plate 24 and second pivoting crusher plate 26 inwardly and guided along the slots 40 in the front crusher plate 22 and engaging the top 50 and bottom 52 of the can 11 and flattening the can 11 as shown. Also seen in this figure and disposed above the flaten can 11 is a crimped can 11 at the bottom of the hopper 12 which is waiting its turn to be received inside the housing 16. As soon as the handle 28 is raised, the flatened can 11 is discharged out the bottom of the crusher 10 and the crimped can 11 takes its place.

It can be appreciated from the above discussion of the structure shown in FIGS. 1 through 5 that the subject can crusher 10 is clearly unique in design. A plurality of cylindrical cans 11 can be quickly and efficiently crimped and crushed as the operator raises and lowers the handle 28 while the cans 11 are fed into the top of the hopper 12.

Changes may be made in the construction and arrangement of the parts or elements of the embodiments as described herein without departing from the spirit or scope of the invention defined in the following claims.

What is claimed is:

1. A can crusher for flatening cylindrical cans, the crusher comprising:

a hopper adapted for receiving a plurality of cans therein, the cans laid on their sides in a horizontal position one on top of the other;

a crusher housing, the hopper attached to and disposed above the housing for feeding the cans individually by gravity into the housing;

a handle pivotally mounted on the housing;

can crushing means adapted for flatening a first can in the housing, the crushing means pivotally attached to the sides of the housing and the handle;

can crimping means mounted on top of the can crushing means adapted for crimping a second can disposed in the bottom of the hopper; and the handle when pivoted on the housing urges the can crimping means and the can crushing means inwardly into the housing, the crimping means engaging the center of the second can and pushing it inwardly as the top and the bottom of the can are folded inwardly toward the center of the can, the can crushing means engaging the folded top and bottom of the first can and flatening the top and bottom of the can against the sides of the can.

2. The crusher as described in claim 1 wherein the crimping means is a vertically mounted crimp pin attached to the top of the can crushing means.

3. The can crusher as described in claim 1 wherein the can crushing means includes a front crusher plate attached to the handle, a first pivoting crusher plate slidably mounted at one end to the front crusher plate, the other end of the first crusher plate pivotally attached to one side of the crusher housing, and a second pivoting crushing plate slidably attached to the other end of the front crusher plate, the other end of the second crusher plate pivotally attached to the opposite side of the crusher housing.

4. The can crusher as described in claim 3 further including a handle pivot link attached to one end of the handle, the handle pivot link pivotally attached to a handle linkage mount, the handle linkage mount attached to the front of the front crusher plate, by pivoting the handle downwardly, the handle pivot link urges the front crusher plate inwardly into the housing thereby pivoting the first crusher plate and the second crusher plate inwardly engaging the folded top and bottom of the first can and flatening the top and bottom of the can against the sides of the can.

5. A can crusher for flatening cylindrical cans, the crusher comprising:

a hopper adapted for receiving a plurality of cans therein, the cans laid on their sides in a horizontal position one on top of the other;

a crusher housing, the hopper attached to and disposed above the housing for feeding the cans individually by gravity into the housing;

a handle pivotally mounted on the housing;

a front crusher plate attached to the handle;

a first pivoting crusher plate slidably mounted at one end to the front crusher plate, the other end of the first pivoting crusher plate pivotally attached to one side of the crusher housing;

a second pivoting crusher plate slidably mounted to the other end of the front crusher plate, the other end of the second crusher plate pivotally attached to the opposite side of the crusher housing;

a vertically mounted crimp pin attached to the top of the front crusher plate; and the handle when pivoted on the housing urges the crimp pin, front crusher plate, first pivoting crusher plate and second pivoting crusher plate inwardly into the housing, the crimp pin engaging the center of a can diposed at the bottom of the hopper and pushing it inwardly as the top and the bottom of the can are folded inwardly toward the center of the can, the first pivoting crushing plate and second pivoting crushing plate engaging the folded top and bottom of another can in the crusher housing and flatening the top and the bottom of the can against the sides of the can.

* * * * *